US005813897A

United States Patent [19]

Van Dan Elzen et al.

[11] Patent Number: 5,813,897

[45] Date of Patent: Sep. 29, 1998

[54] YO-YO HAVING AN IMPROVED TETHER ENGAGEMENT AREA

[75] Inventors: Hans W. Van Dan Elzen, Tempe; Thomas J. Van Dan Elzen, Oro Valley, both of Ariz.

[73] Assignee: Playmaxx, Inc., Tucson, Ariz.

[21] Appl. No.: 855,711

[22] Filed: May 8, 1997

[51] Int. Cl.[6] ..... A63H 1/30

[52] U.S. Cl. ..... 446/250

[58] Field of Search ..... 446/248, 249, 446/250, 251, 252, 253, 254

[56] References Cited

U.S. PATENT DOCUMENTS

| | | | |
|---|---|---|---|
| D. 366,289 | 1/1996 | Newcomer . | |
| 3,175,326 | 3/1965 | Isaacson . | |
| 3,201,895 | 8/1965 | Stivers . | |
| 3,256,635 | 6/1966 | Radovan | 446/251 |
| 3,717,949 | 2/1973 | Radovan | 446/251 X |
| 3,805,443 | 4/1974 | Duncan, Jr. . | |
| 4,130,962 | 12/1978 | Ennis | 446/250 |
| 4,207,701 | 6/1980 | Kuhn | 446/250 |
| 4,332,102 | 6/1982 | Caffrey | 446/250 |
| 4,895,547 | 1/1990 | Amaral . | |
| 5,017,172 | 5/1991 | Seifert | 446/250 |
| 5,100,361 | 3/1992 | Kuhn et al. . | |

FOREIGN PATENT DOCUMENTS

| | | |
|---|---|---|
| 2132l100 | 7/1984 | United Kingdom . |

*Primary Examiner*—Robert A. Hafer
*Assistant Examiner*—Jeffrey D. Carlson
*Attorney, Agent, or Firm*—Franklin L. Gubernick

[57] ABSTRACT

A yo-yo having unique tether engagement areas adjacent the axle. The engagement areas include a starburst pattern of grooves located in the tether-facing surface of each of the yo-yo's side pieces. The grooves extend from a point proximate the axle to a point significantly spaced from the axle. In the preferred embodiment, the grooved engagement area is employed in conjunction with an axle having a ball bearing supported rotatable outer race to which an end loop of the tether is secured.

14 Claims, 2 Drawing Sheets

YO-YO HAVING AN IMPROVED TETHER ENGAGEMENT AREA

FIELD OF THE INVENTION

The invention is in the field of user-manipulated toys. More particularly, the invention is an apparatus in the form of a yo-yo that functions in an improved manner relative to the prior art. This is achieved through the use of a specially-designed tether engagement area proximate the yo-yo's axle.

The tether engagement area makes use of a starburst pattern of elongated grooves located on the tether-facing surface of each of the yo-yo's side members. The grooves function to facilitate engagement between the tether and the yo-yo's side members.

BACKGROUND OF THE INVENTION

A yo-yo is often thought of as one of the simplest toys in the world. Most yo-yo's include two disk-shaped side members that are rigidly connected to each other by a wooden or metal axle. One end of a string-type tether is secured to the yo-yo's axle. A second end of the tether includes a loop that is placed about one of the user's fingers to thereby secure the yo-yo to the user. When the tether is wound about the axle and the yo-yo is released from the user's hand, the yo-yo will begin to rapidly spin as the tether unwinds from the axle. When the tether is fully unwound, the yo-yo may "sleep" at the end of the tether whereby the yo-yo continues to spin without having the tether rewind on the axle.

Once the yo-yo is sleeping, there are a number of yo-yo tricks one can perform with the spinning yo-yo. In some of these tricks, the spinning yo-yo is temporarily placed upon a portion of the tether intermediate of the tether's two ends. At the end of most yo-yo tricks, the user will jerk his or her hand or in some other fashion cause the tether to go momentarily slack. This causes the tether to engage the axle and/or the tether-facing surface of at least one of the yo-yo's side members. Once engagement has occurred, the end portion of the tether will move with the side member(s) and thereby wind about the axle. Winding of the tether on the axle causes the yo-yo to return to the user's hand.

There are three crucial performance characteristics of a yo-yo that enable a user to perform most of the well-known yo-yo tricks. The yo-yo must be capable of sleeping for an extended period of time, it must not be subject to inadvertent snagging on the tether, and it should return on command.

Concerning a yo-yo's sleep time, the longer the yo-yo can be made to sleep, the more time the user will have to complete any particular yo-yo trick. It is well known that by minimizing friction in the yo-yo, one can maximize the yo-yo's sleep time.

Concerning the ability of a yo-yo to not snag the tether, when a snag occurs, the yo-yo will automatically rewind on the tether. When this happens inadvertently, the trick will often be ruined. The primary factors that influence whether a yo-yo will tend to accidentally snag on the tether are the yo-yo's string gap (the area between the two side members in which the string/tether is located) and the configuration of the tether-facing surface of each end member. For tricks in which the yo-yo is placed on an intermediate portion of the tether, the string gap must be sufficient to receive a second portion of the tether either atop or more preferably beside the permanently secured portion of the tether. To avoid premature rewinding of the tether, the gap must be wide enough so that the second tether portion can be received in a manner whereby it will not snag on the axle or on either of the side members. However, too wide a string gap may preclude a user's ability to have the yo-yo return on command since the wide gap may make it impossible for the tether to sufficiently engage either side member to cause the yo-yo's return Concerning the ability of a yo-yo to return on command, when the yo-yo is spinning at the end of the tether and the user causes the tether to slacken momentarily, the structure and design of the yo-yo must be such that the slack tether need only move slightly to thereby engage/snag the axle and/or side members. Once engagement occurs, the tether should then wind tightly on the axle so that upon the yo-yo's next release from the user's hand, the unwinding of the tether will cause the maximum rotational speed of the yo-yo. The ability of the tether to engage the spinning portions of the yo-yo is dependent on the string gap's size and shape, and is often facilitated through the use of particular adaptations in the tether-facing surface of each of the side members.

In the prior art, there have been a number of inventions designed to enhance one or more of the above-listed yo-yo characteristics. For example, both Kuhn et al (U.S. Pat. No. 5,100,361) and Isaacson (U.S. Pat. No. 3,175,326) teach low-friction yo-yo's in which the axle includes ball bearings to enable an outer portion of the axle to spin relative to the yo-yo's side members. In these yo-yos, the end of the tether is secured to the outer rotatable portion of the axle. When the yo-yo is in a sleeping condition, said outer portion of the axle will remain stationary while the rest of the yo-yo spins. This eliminates the creation of friction between the axle and the tether. Furthermore, by eliminating the rubbing contact between the axle and the tether, this construction alleviates the problem of rapid tether failure due to frictional heating and wearing of the portion of the tether that contacts the axle. However, the reduced friction makes this type of yo-yo harder to return from a sleeping condition.

To enable the yo-yo to be manipulated on the tether without inadvertently having the side members snag/engage the tether, the yo-yo taught in the above-noted Kuhn patent allows adjustment of the spacing between the two side members. However, in the Kuhn yo-yo as well as in all other prior art yo-yos, a compromise must be made between a wide string gap that would reduce the chance of the tether inadvertently engaging either of the side members and a narrow string gap that would increase the chance of said engagement when the user desires the yo-yo to rewind on the string. This makes proper adjustment of the Kuhn yo-yo difficult to achieve and maintain. In every prior art yo-yo, this compromise limits the performance of the yo-yo.

To make it easier for a user to have the yo-yo return on command, Amaral (U.S. Pat. No. 4,895,547) and others teach yo-yos in which the tether-facing surface of each side member includes a plurality of raised ribs that project toward the tether. The ribs are arrayed in a starburst pattern about the center axis of the yo-yo. When the yo-yo is spinning at the end of the tether and the tether is momentarily made slack by the user, the portion of the tether proximate the yo-yo's axle will engage one or more of the ribs to thereby cause the tether to wind about the axle. However, since the ribs protrude from the side members, they effectively define the sides of the string gap and can make it more difficult to perform yo-yo tricks without having the tether inadvertently engage said ribs. In addition, premature tether breakage may occur due to frequent rubbing contact between the ribs and the tether. Furthermore, since the prior art ribs are taught as being angled relative to the substantially planar tether-facing surface of their associated side member, the ribs cause the string gap to vary in width dependent on the distance from the axle. This may cause the yo-yo to respond differently as the degree of twist in the tether changes. This occurs since the tether's twist affects the location of the beginning point of the tether's end loop (the portion of the tether that permanently encircles the axle) and that point is often the initial point of engagement between the tether and one or the other of the side members.

SUMMARY OF THE INVENTION

The invention is an improved yo-yo in which the structure of the yo-yo in the area of the string gap is modified to enhance the yo-yo's performance while minimizing or negating many of the performance problems of the prior art. In the preferred embodiment of the invention, the yo-yo includes an axle that incorporates ball bearings for supporting an outer, rotatable cylindrical portion. The tether-facing surface of each side member is adapted to facilitate controlled engagement of the tether through the use of a plurality of radially-oriented, elongated grooves that extend from a point proximate the axle to an outer point significantly spaced from said axle. When engagement between the tether and a groove occurs, a portion of the tether becomes caught in the groove and is thereby forced to rotate with the associated side member. This causes the tether to wrap about the axle and the yo-yo to return to the user's hand.

The grooves form a starburst pattern about the center of the tether-facing surface of each side member. Each groove preferably has maximum width and depth dimensions that are equal to or greater than one-half of the diameter of the tether string. It should be noted that the width and depth of each groove may vary along the length of the groove. The edges of the groove located at the surface of the side member provide a relatively sharp edge for snagging the tether when said tether contacts any of the grooves. In the preferred embodiment, the grooves have a 'U'-shaped cross-section and are located whereby they are at 10–45 degree spacings about the center axis of each side member.

By employing a tether engagement surface that only contacts the tether when the user causes said engagement, the invention eliminates the friction experienced by the prior art yo-yos that employed inwardly-projecting ribs that would occasionally rub on the tether. As a result, both the potential spin time of the yo-yo and the expected life of the tether are increased. By using a starburst pattern of grooves in conjunction with an axle that incorporates ball bearings, the resultant yo-yo can spin almost free from frictional slowing and is therefore capable of sleeping for a significantly extended period of time.

The use of grooves that feature elongated side edges provide an extended area for engagement with the tether and allow engagement even at locations that are significantly spaced from the yo-yo's axle. The extended area of engagement is virtually impossible in the prior art yo-yos that employ ribs to facilitate engagement since any increase in the length of the ribs would tend to increase the chance of inadvertent snagging of the tether whenever the tether is not perfectly perpendicular to the yo-yo's center axis.

In addition, the use of grooves significantly reduces the chance of inadvertent snagging of the tether. Only when the user causes a momentary slackening of the tether will the resultant temporary expansion and/or sideways movement of the tether cause the tether to engage the side edge of at least one of said grooves.

Since the grooves are recessed in the tether-facing surface of each side member, the string gap can be uniform in width, and the tether will normally only contact the engagement means (the grooves) when the tether is placed into a slackened condition. This is unlike the prior art yo-yo's that featured short, angled ribs.

The use of grooves also enables the string gap area to be defined by the relatively perpendicular surfaces of the axle and the side member. Since these surfaces meet at substantially right-angled transition points, they provide an ideal geometry for enabling user control of the yo-yo.

The use of a plurality of grooves spaced about the axle also provides a large number of engagement points for the tether. This further increases the ease of having the yo-yo return on command from a sleeping condition.

DETAILED DESCRIPTION OF THE DRAWINGS

Figure 1:
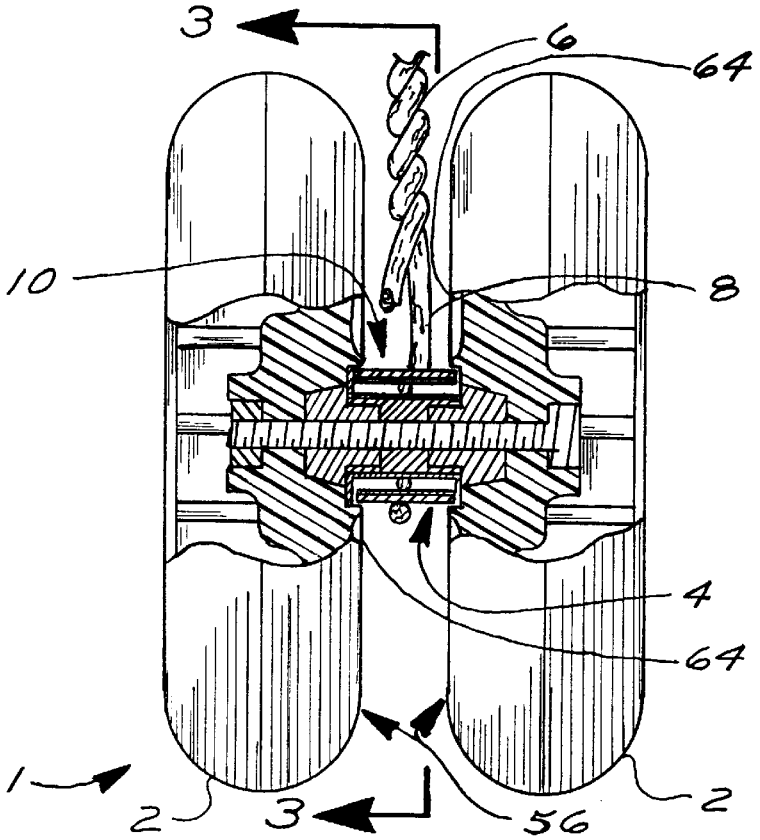
FIG. 1 is an elevational view, partially in cross-section, of a yo-yo in accordance with the invention.

Referring now to the drawings in greater detail, wherein like characters refer to like parts throughout the several figures, there is shown by the numeral 1 a yo-yo in accordance with the invention.

The yo-yo 1 includes first and second disk-shaped side members 2 that are connected together via an axle assembly 4. A string-type tether 6 includes a loop portion 8 that encircles a center portion 10 tether anchor of the axle assembly. A distal portion (not shown) of the tether would normally be secured to one of a user's fingers.

As known in the art, each side member 2 includes an annular rim portion 12 (note FIG. 2), a hub 14 and a thru-bore 16 that extends through the side member, including the center of the hub. The side member also features a removable disk-shaped cap 18. Most of the side member's weight is concentrated in the rim portion to thereby provide the yo-yo with favorable balance and spin characteristics. The side members may be made of any well-known rigid or substantially rigid material such as wood, plastic or metal. In the preferred embodiment, each side member is made of a rigid plastic material.

Figure 2:
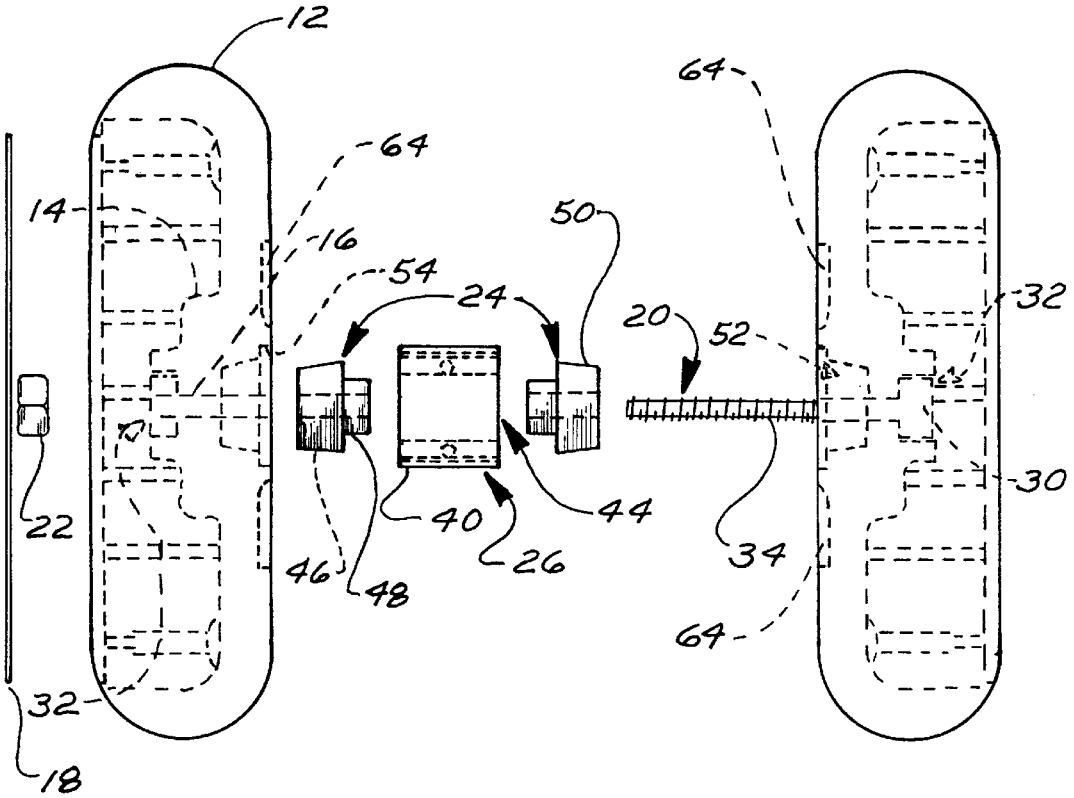
FIG. 2 is an exploded, elevational view of the yo-yo shown in FIG. 1.

FIG. 2 shows an exploded view of the yo-yo shown in FIG. 1. In this view, it can be seen that the axle assembly 4 includes an axle pin 20, a securement nut 22, two spacers 24 and a ball bearing unit 26. The axle pin is in the form of a hex head bolt in which the head 30 is non-rotatably secured within an open-ended hexagonally-shaped cavity 32 formed in the hub 14 of the right-hand side member 2. The left-hand side member 2 also includes an identical open-ended cavity 32 in which the hexagonally-shaped securement nut 22 is snugly and non-rotatably received. The nut 22 is normally threadedly engaged to a threaded portion 34 of the pin to thereby secure the two side members 2 together. If one desires to disassemble the yo-yo, the nut 22 can be unscrewed from the pin 20 by rotation of either of the yo-yo's side members 2 relative to the other.

Figure 3:
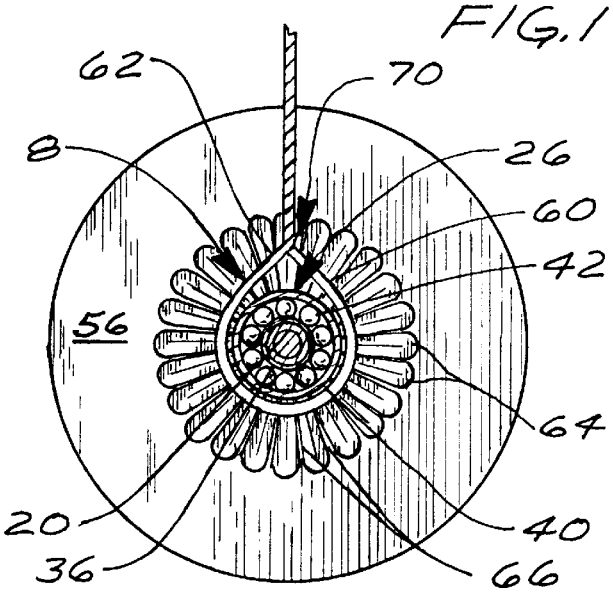
FIG. 3 is a sectional view of the yo-yo shown in FIG. 1 and taken at the plane labeled 3—3 in FIG. 1.

As can be seen in FIG. 3, the ball bearing unit 26 is conventional in design and basically includes an inner race 36, an outer race 40 and a plurality of ball bearings 42 located therebetween. It should be noted that other types of bearings, such as roller bearings, or other types of rotatable units, may be alternatively employed. The unit 26 is preferably of the type that cannot be disassembled. The inner race includes a thru-hole 44 through which the axle pin passes when the yo-yo is in an assembled condition.

Each spacer 24 includes a thru-hole 46 through which the axle pin will also pass. To secure the ball bearing assembly, each spacer 24 includes a reduced-diameter first end portion 48 that is removably received within the thru-hole 44 of the ball bearing unit. Once received, the shoulder at the inner end of portion 48 (note FIG. 1) will abut and contact the inner race 36 but will not contact the outer race 40. Each spacer includes a second end portion 50 adapted to be tightly, and immovably, received within a complementary cavity 52 in each side member 2.

When the yo-yo is assembled, portion 50 of each spacer is located completely within and contacts the associated side member. At the same time, a side edge of the outer race 40 is also received within a complementary recess 54 in the side member. It should be noted that the outer race does not contact either of the side members and therefore can move independently of said side members. The spacers bracket the bearing assembly as shown and position the outer race so that it is perpendicular to the plane of the tether-facing surface 56 of each side member without contacting said surface of either side member. It should also be noted that the inner race 36 of the ball bearing engages both of the spacers to thereby become locked to the side members and rotatable therewith.

FIG. 3 provides a detailed view of the tether's securement to the axle assembly as well as a view of the tether-facing surface 56 of one of the side members 2. It should be noted that the tether-facing surface of the other side member 2 is identical to the surface shown.

To manufacture the tether 6, one long string is folded on itself and the two halves of the string, 60 and 62, are twisted together. As a result, the tether has a diameter D which is actually twice the diameter of either of the string halves 60 or 62. To secure the tether to the yo-yo, the end of the tether where string halves 60 and 62 join together is untwisted to thereby form a loop 8 that is placed about the outer race 40 of the ball bearing unit.

When the yo-yo is sleeping at the end of the tether and the user causes the tether to become momentarily slack, the tether will no longer be constrained by the yo-yo's pull on the tether to stay located at the center of the string gap. In addition, as the tension in the tether is reduced, the diameter of the tether will also increase slightly, much in the same way as any rope will slightly increase in diameter as tension is removed. These factors allow a portion of the tether located in the string gap (the area between the side members 2, measured proximate the axle assembly) to engage the surface 56 of one or both of the side members 2. To enhance the engagement so that the tether will begin to rotate with the spinning side members, the invention employs a plurality of radially-oriented elongated grooves 64 that function to snag the tether as soon as the tether contacts surface 56. The area of the surface 56 that includes the grooves 64 is considered the tether engagement area.

Each of the grooves 64 has a longitudinal axis that is parallel to the tether-facing surface 56 of the associated side member and perpendicular to the center axis of the yo-yo as defined by the longitudinal axis of the axle pin 20. The grooves are similar in shape to a teardrop (other elongated shapes may be employed) and each features two long sides 66 that form a sharp, right-angled edge where they intersect with the substantially planar surface 56 of the side member. Preferably, each groove has maximum width and depth dimensions that are at least equal to ½D (½ the tether diameter). The width and depth dimensions may vary with the distance away from the yo-yo's center axis. The length of the grooves must take the tether configuration into account.

As can be seen in FIG. 3, the two strands 60 and 62 that form the tether separate from each other at a point labeled 70 to form the tether's loop 8. As noted previously, the point at which the strands unite can vary in distance from the axle dependent on the amount of twist in the tether. Since point 70 will sometimes define the initial contact point between the tether and a side member, the length of the grooves must be such that they can engage point 70 even when said point is closely spaced to or distantly spaced from the axle assembly.

In the preferred embodiment, each side member 2 has a diameter of approximately 2.2 inches, the ball bearing unit (which can also be considered the yo-yo's axle means) has an outer diameter of approximately 0.4 inches, the string gap is approximately 1.5–2.0 times the tether diameter, and each groove has a length of approximately ⅓ of an inch. To be effective, the grooves should have a minimum length of approximately ½ of the diameter of the axle means. The grooves can have a maximum length of almost one-half of the diameter of the side member. In yo-yo's that have a different ratio of side member diameter to axle means diameter, the grooves should have a minimum length that will enable contact with point 70 of the tether no matter the degree of twist in said tether.

In an alternate embodiment that is not shown, the grooves are located in a separate disk-shaped member. Said member is non-rotatably secured within a complementary recess in the tether-facing surface of an associated side member.

Figure 4:
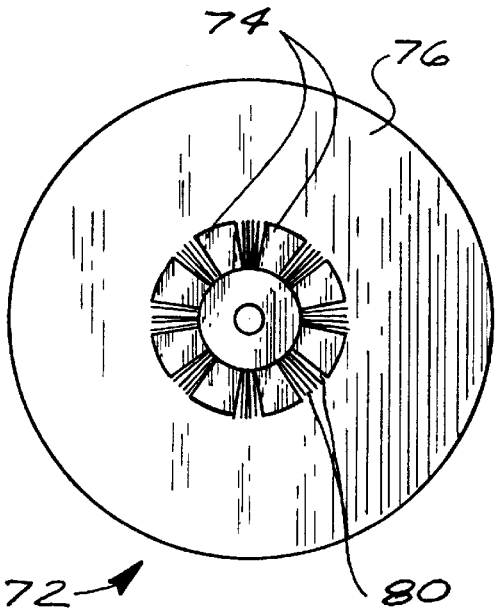
FIG. 4 is an elevational view of the tether-facing surface of a side member of a yo-yo similar to the one shown in FIG. 1. This view shows an alternate form of tether engagement area.

FIG. 4 shows an alternate embodiment of the tether engagement area of a side member 72. Side member 72 is identical to side member 2 except for differences in the tether engagement area. In this embodiment, there are a plurality of large, radially-oriented, elongated grooves 74. In the area between the grooves, the tether-facing surface 76 of the side member includes a plurality of much smaller radially-oriented grooves 80. The smaller grooves can be used to provide an engagement area with the tether or to help guide the tether into the larger grooves when the tether is placed in a slackened condition.

It should be noted that the use of radially-oriented tether engagement grooves, as taught herein, can be employed with other types of yo-yos. For example, the grooves can facilitate tether engagement in conventional yo-yos that make use of a fixed axle (i.e.-an axle that is fixed to the side members and does not incorporate a ball bearing supported portion).

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A yo-yo comprising:

first and second side members;

a tether anchor located between said side members;

a securement means for securing together said side members;

a tether secured to said tether anchor and adapted to be wound thereon; and wherein each of said side members includes a center portion encircled by a rim portion, wherein said center portion has a sidewall adjacent said tether, wherein said sidewall includes a first surface and a second surface, wherein said first surface faces away from said tether and in conjunction with a surface of the rim portion forms a concave area that faces away from said tether, wherein said second surface, in an area adjacent said tether anchor, faces said tether, is planar and is oriented substantially perpendicular to a center axis of said tether anchor, wherein said second surface includes a plurality of elongated grooves proximate said tether anchor and adapted for engagement to said tether, wherein each of said grooves is indented in said planar portion of said second surface and has a bottom portion that is indented in said sidewall and is recessed relative to a plane formed by a portion of said second surface proximate said tether anchor, and wherein said grooves are radially-oriented about said center axis of said tether anchor.

2. The yo-yo of claim 1 wherein a plurality of said grooves begin at a point proximate the tether anchor and extend away from said axle means.

3. The yo-yo of claim 1 wherein the tether has a diameter and each of a plurality of said grooves has a maximum width that is at least equal to one-half of said diameter of said tether.

4. The yo-yo of claim 1 wherein the tether has a diameter and each of a plurality of said grooves has a maximum depth that is at least equal to one-half of said diameter of said tether.

5. The yo-yo of claim 1 wherein the tether anchor includes an inner race, an outer race and a plurality of bearing members located between said races and wherein said tether includes a loop portion that encircles said outer race.

6. The yo-yo of claim 1 wherein said yo-yo has a string gap area defined as an area exterior to and coextensive with the tether anchor and located between the side members, wherein said string gap area in a region contiguous to and coextensive with said grooves is constant in width and wherein said grooves are located adjacent to the string gap area.

7. The yo-yo of claim 1 wherein the tether anchor has an outer diameter and wherein each of a plurality of said grooves has a length at least equal to one-half of said outer diameter of said tether anchor.

8. The yo-yo of claim 1 wherein each of said side members has an outer diameter and wherein a plurality of said grooves has a length no greater than one-half of the outer diameter of the associated side member.

9. The yo-yo of claim 1 wherein each side member is made of a plastic material and said grooves are integral with their associated side member.

10. The yo-yo of claim 1 wherein the tether anchor includes an outer portion made of a metal material.

11. The yo-yo of claim 1 wherein the grooves have a width Y and form a set of primary grooves and wherein the tether facing surface that includes said primary grooves also includes a plurality of secondary grooves and wherein each of said secondary grooves has a width less than Y and wherein a plurality of said secondary grooves are located between two adjacent primary grooves.

12. The yo-yo of claim 1 wherein the grooves are spaced at no more than 45 degree intervals about said center axis.

13. The yo-yo of claim 1 wherein the tether has a predetermined diameter and the yo-yo has a string gap in the range of 1.5–2.0 times said predetermined diameter of said tether.

14. A yo-yo comprising:

first and second side members;

a tether anchor located between said side members;

a securement means for securing together said side members;

a tether secured to said tether anchor and adapted to be wound thereon; and wherein each of said side members has a center portion surrounded by a rim portion, wherein said center portion has a sidewall adjacent said tether, wherein said sidewall includes a tether-facing surface located adjacent said tether anchor, wherein said sidewall also includes a rear surface that faces directly away from said tether, wherein said rim portion is in the form of an annulus and has a portion that extends away from said tether past the sidewall's rear surface, wherein said tether-facing surface of at least one of said side members is planar and includes a plurality of elongated engagement means arranged in a starburst pattern about the center of the associated side member and capable of engaging said tether, wherein said engagement means comprises a plurality of grooves indented in said planar portion of said tether facing surface of said sidewall and wherein each of said grooves extends into the associated side member in a direction away from the tether-facing surface.

* * * * *

UNITED STATES PATENT AND TRADEMARK OFFICE

CERTIFICATE OF CORRECTION

PATENT NO. : 5,813,897

DATED : Sep. 29, 1998

INVENTOR(S) : Hans W. Van Dan Elzen & Thomas J. Van Dan Elzen

It is certified that error appears in the above-indentified patent and that said Letters Patent is hereby corrected as shown below:

In Claim 1, line 23, delete "indented" and insert in its place--formed--.

Signed and Sealed this

Thirty-first Day of August, 1999

*Attest:*

Q. TODD DICKINSON

*Attesting Officer*

*Acting Commissioner of Patents and Trademarks*